United States Patent [19]

Wolbrink et al.

[11] Patent Number: 4,465,256

[45] Date of Patent: Aug. 14, 1984

[54] MOUNTING DEVICE FOR RANGE HOODS

[75] Inventors: David W. Wolbrink; Kenneth J. Jonas, both of Hartford; Roland E. Butt, West Bend; Robert W. Busch, Hartford, all of Wis.

[73] Assignee: Broan Mfg. Co., Inc., Hartford, Wis.

[21] Appl. No.: 324,460

[22] Filed: Nov. 24, 1981

[51] Int. Cl.[3] ..... F16M 13/00

[52] U.S. Cl. ..... 248/544; 248/674; 248/201; 312/245; 312/278

[58] Field of Search ..... 248/674, 201, 220.2, 248/224.4, 216.1, 546, 547, 48.1, 48.2, 544, 73, DIG. 6; 52/656, 34, 35, 36; 312/245, 257 SK, 257 A, 278; 40/152.1, 588; 126/299 R; 160/135

[56] References Cited

U.S. PATENT DOCUMENTS

| | | | |
|---|---|---|---|
| 799,092 | 9/1905 | Rosenfeld | 248/73 |
| 1,597,243 | 11/1924 | Newman | 248/DIG. 6 |
| 1,963,951 | 3/1932 | Bowers | 248/DIG. 6 |
| 2,078,581 | 12/1935 | Muller | 312/245 |
| 2,661,677 | 9/1948 | Lingelbach | 248/57 |
| 2,733,887 | 2/1956 | Schmidt | 248/224.4 |
| 3,915,308 | 10/1975 | Ratzloff | 248/201 |
| 4,342,439 | 8/1982 | Bruner | 312/245 |

FOREIGN PATENT DOCUMENTS

| | | | |
|---|---|---|---|
| 160396 | 3/1933 | Switzerland | 248/546 |

*Primary Examiner*—William H. Schultz
*Assistant Examiner*—Robert A. Olson
*Attorney, Agent, or Firm*—Andrus, Sceales, Starke & Sawall

[57] ABSTRACT

A mounting device for securing a range hood beneath a soffit having a framing member fastened to a wall. The device has an elongated mounting plate suitable for being secured along and to the framing member. A pair of hangers depend from the mounting plate and are connected thereto at spaced locations along the mounting plate. The hangers secure the range hood to the mounting device.

9 Claims, 6 Drawing Figures

MOUNTING DEVICE FOR RANGE HOODS

The present invention relates to an improved device for mounting a range hood on a wall. The range hood is typically of the type having a shelf for a microwave oven or other object.

Range hoods are mounted above kitchen ranges to draw off odors or smoke produced during cooking by means of a blower contained in the hood. Range hoods are fabricated from sheet metal and contain relatively lightweight components so that attaching the hood to the wall or adjacent cabinetry has been easily accomplished in the past by conventional fastening techniques.

Recently, however, range hoods have been combined with appliances, such as microwave ovens. These hoods locate the microwave oven in a convenient position above the range while continuing to provide for the removal of odors and smoke. The range hood and microwave oven may be a single unit. Or, the range hood may be designed with a shelf on which the microwave oven may be removably placed. Supporting a microwave oven, that may weigh up to 100 pounds, renders the mounting of the range hood extremely critical because of safety reasons and to avoid potential damage to the range, hood, and microwave oven. Attaching the range hood to the wall covering, such as gypsum board, is usually inadequate.

It might be assumed that wall studs would be available for securing the range hood. But, depending on the spacing of the studs and the size of the hood, only one such stud may be available. This precludes the requisite certainty of attachment.

It is, therefore, the object of the present invention to provide an improved mounting device for securely attaching a range hood to a wall so that loads, such as microwave ovens, may be safely applied to the range hood.

The improved mounting device includes a horizontally oriented mounting plate suitable for being secured to a framing member fastened to the wall at a plurality of its studs. The framing member may typically form a portion of the soffit of the kitchen cabinetry. A pair of laterally spaced hangers are connected to the mounting plate and depend therefrom. The hangers contain means by which the range hood may be attached to the mounting means. Since the mounting plate is adapted to be secured to the stud mounted framing member rather than the wall itself, the range hood and its associated loads may be safely supported.

The invention may be further understood with the aid of the accompanying drawing in which.

Figure 4:
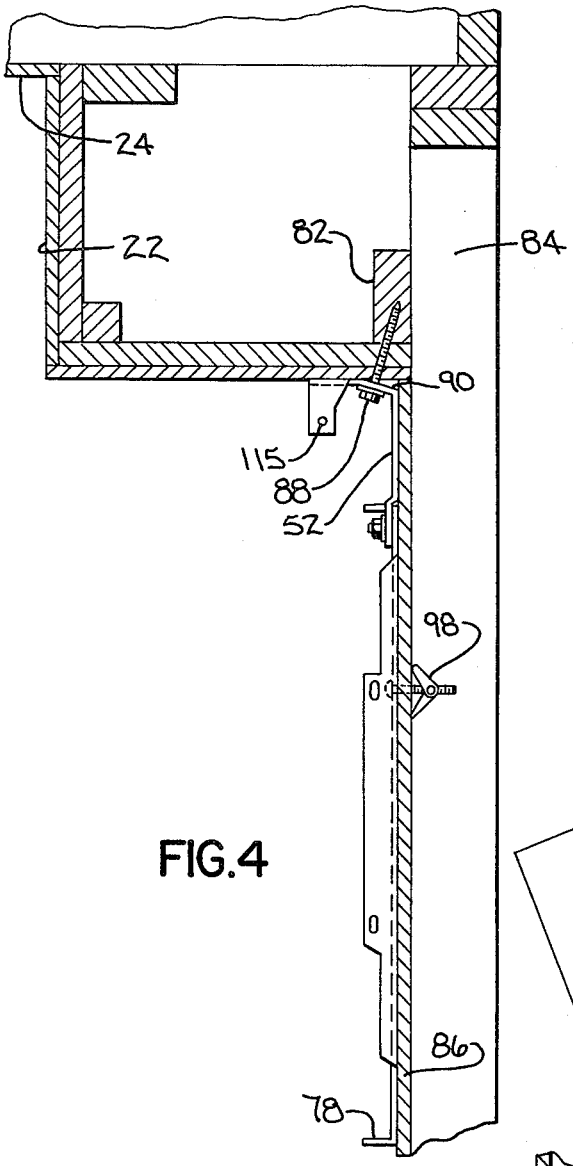
Figure 5:
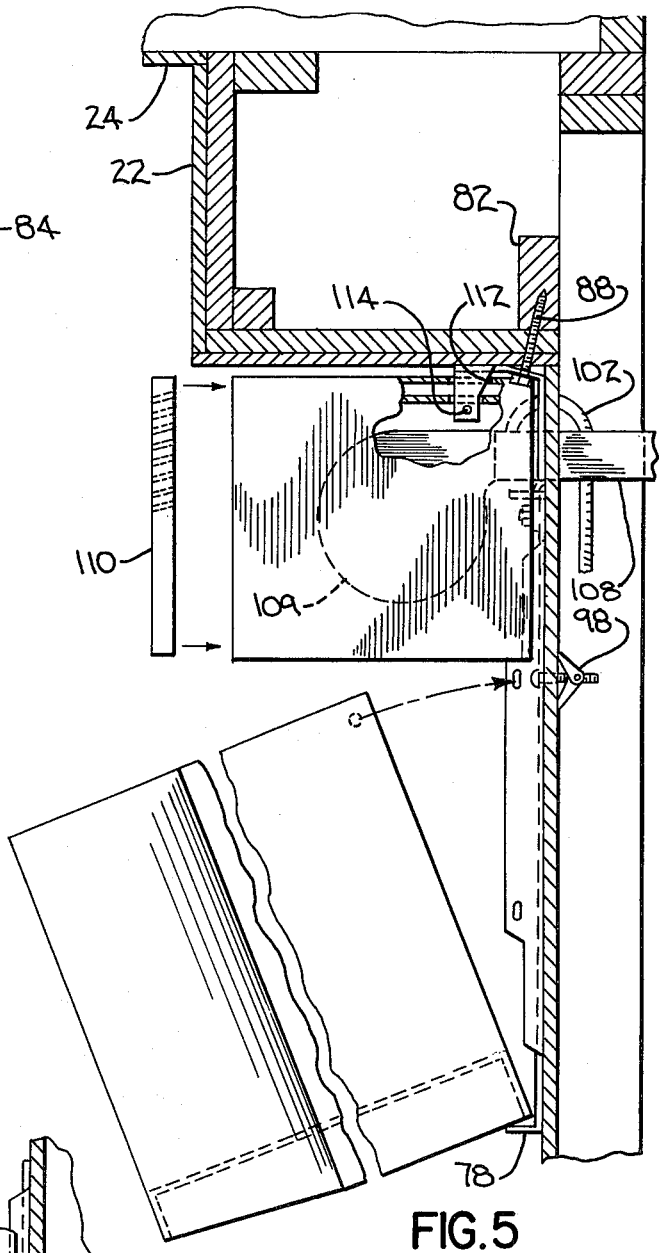
Figure 6:
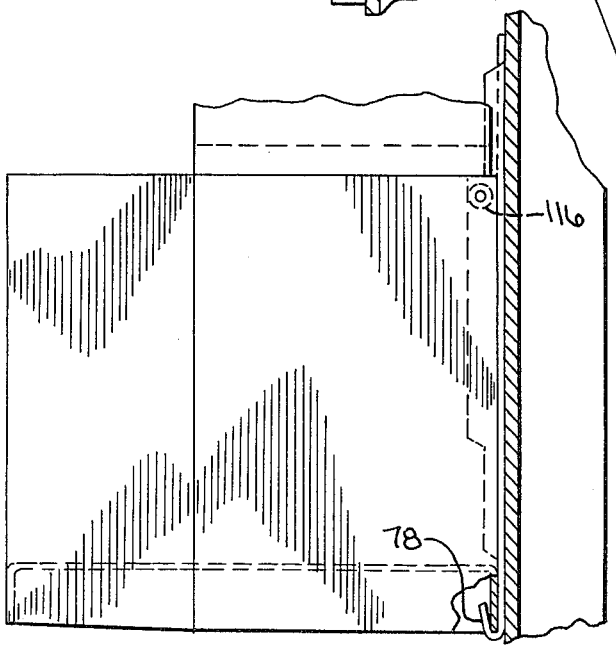

FIGS. 4, 5, and 6 are partial side views showing installation of the mounting means and attachment of the range hood.

Figure 1:
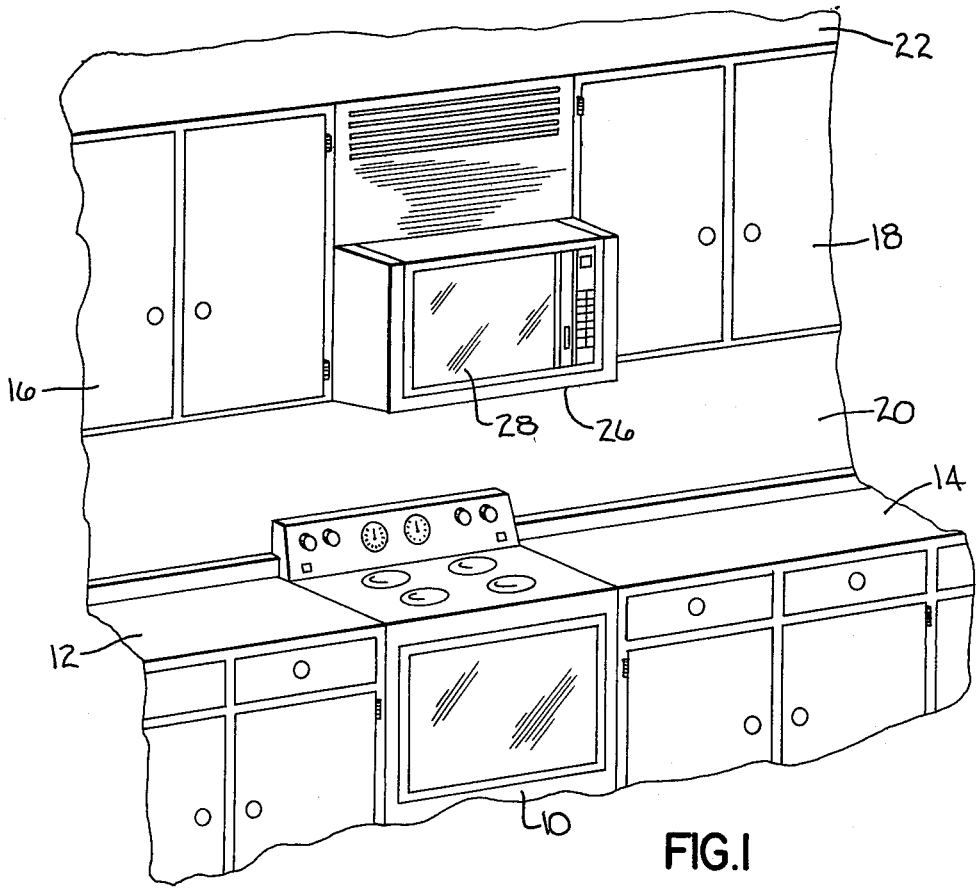
FIG. 1 is a partial perspective view of a kitchen range, the associated countertops and cabinetry, and a range hood with a microwave oven appliance.

FIG. 1 shows kitchen range 10 with countertops 12 and 14 extending on either side thereof. Cabinets 16 and 18 are mounted on wall 20 above countertops 12 and 14.

Soffit 22 extends from the top of cabinets 16 and 18 to ceiling 23, as shown most clearly in FIGS. 4 and 5.

Figure 2:
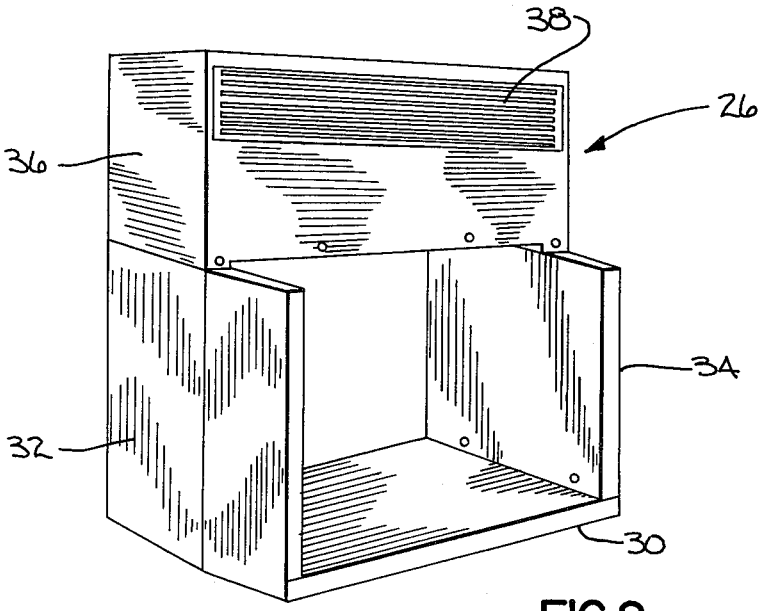
FIG. 2 is a perspective view of a range hood with which the present invention may be used, the range hood being of the type having a shelf on which an appliance may be removably placed.

Range hood 26 is positioned between cabinets 16 and 18, below soffit 22, and above range 10. As shown in FIG. 2, range hood 26 includes a hood portion 30 that collects the odors and fumes rising from range 10. Ducts 32 and 34 extend along either side of the hood. The top of hood portion 30 and the inner sides of ducts 32 and 34 form a shelf suitable for receiving an object, such as microwave oven appliance 28.

The upper ends of ducts 32 and 34 connect to housing 36. A blower in housing 36 may either pass the odors and fumes through a filter and return the air to the room through grill 38 or discharge them from the kitchen to the exterior of the building through an exhaust duct. Housing 36 is separable from hood portion 30 and ducts 32 and 34 to facilitate installation of the hood, as hereinafter described.

Figure 3:
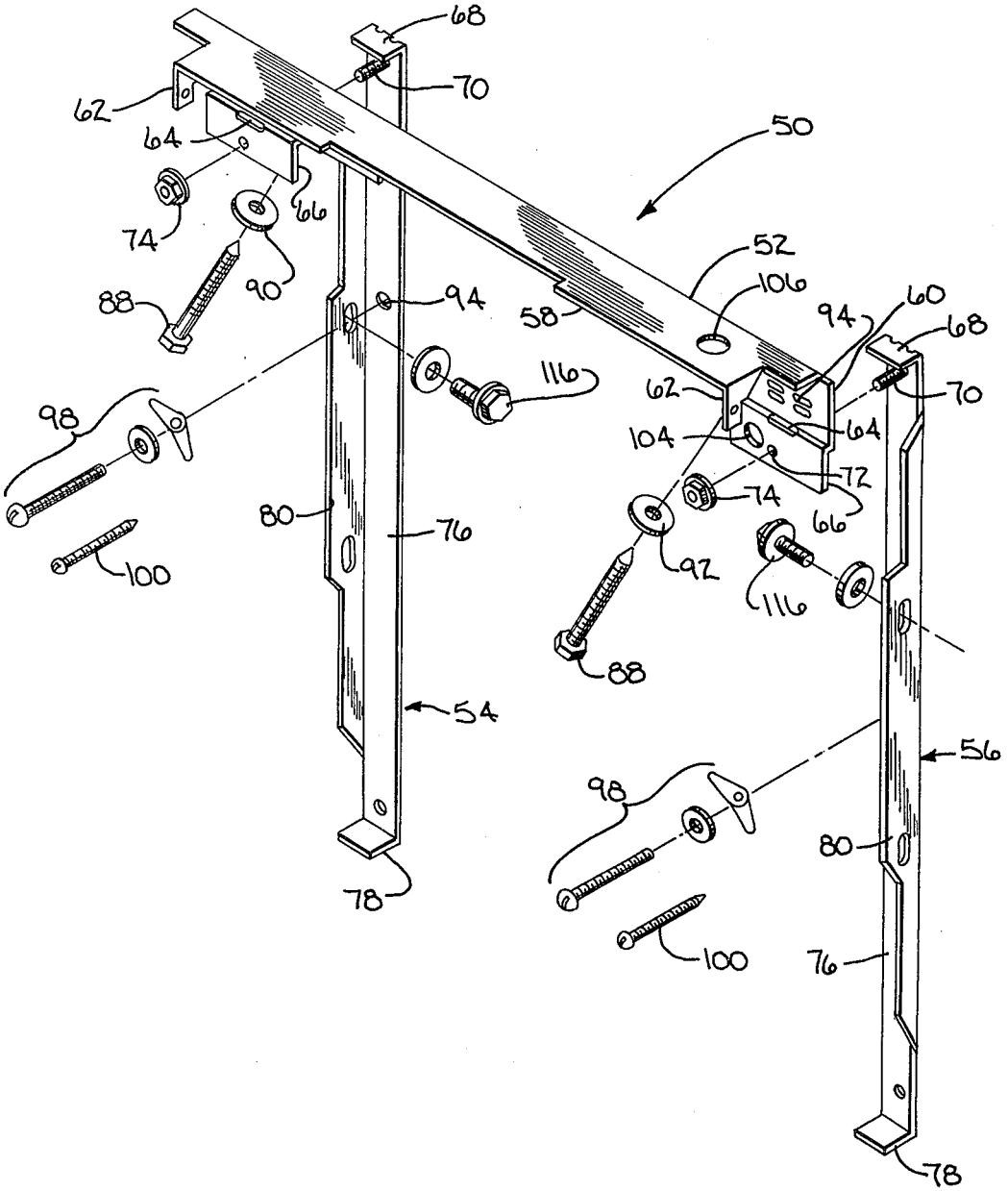
FIG. 3 is an exploded perspective view of the improved mounting device of the present invention with associated hardware.

FIG. 3 shows the improved mounting device 50 of the present invention. Mounting device 50 includes mounting plate 52 and hangers 54 and 56. Mounting plate 52 has first flange 58 that is horizontal when mounting means 50 is in use and a second, vertical flange 60. Horizontal flange 58 contains bent down ears 62 at the ends thereof for a purpose hereinafter described. Vertical flange 60 contains slots 64 adjacent stepped end portions 66 for receiving upper lips 68 of hangers 54 and 56 so that the hangers may be suspended from the mounting plate. The hangers are attached to mounting plate 52 by bolts 70, stud welded to the hangers, extending through holes 72 in vertical flange 60, and receiving nuts 74.

Hangers 54 and 56 each contain a strap portion 76, terminating in lower lip 78, and a flange 80.

FIGS. 4 through 6 show use of mounting device 50 in mounting range hood 26 above kitchen range 10. FIGS. 4 and 5 show the construction of soffit 22 extending above cabinets 16 and 18 to include framing member 82 extending transverse to studs 84 and nailed to several of them. The wall defined by studs 84 is covered by wall board 86. Mounting plate 52, with hangers 54 and 56 attached, is centered between cabinets 16 and 18 and secured to framing member 82 by lag screws, one of which is shown as 88 in FIGS. 4 and 5. The lag screws slant upwardly and inwardly into framing member 82. An appropriate drilling template may be employed to properly angle the pilot holes for lag screws 88. Two such lag screws may be employed, one adjacent each end of mounting plate 52. Mounting plate 52 may include surface 90 between horizontal flange 58 and vertical flange 60 that slants to meet the head of lag screws 88 and the associated washers 92 squarely to enhance the attachment of mounting plate 52 to framing member 82. In the event there is no soffit 22 above range 10 and cabinetry 16-18 a 2×4 of appropriate length, for example, 6 ft., is nailed to wall studs 84. Should studs 84 be available for fastening mounting plate 52 may be additionally secured by fasteners driven through holes 94 in vertical flange 60 into the studs.

Hangers 54 and 56 are then fastened to the wall by fasteners inserted through holes 94 in strap portions 76. FIGS. 3 and 4 show toggle bolt fasteners 98 for fastening the straps to wall board 86. If one or both of holes 94 are aligned with studs 84, conventional fasteners 100 may be used.

The necessary wiring 102 for the blower in housing portion 36 and for appliance 28 is pulled through wall 86 or soffit 22 and through hole 104 or 106 in mounting plate 52. If range hood 26 is to be vented to the exterior, an exhaust duct 108 is provided in the wall 86 or in soffit 22 for connection to blower 109.

The front panel 110 of blower housing 36 is removed. Housing 36 is lifted into position beneath soffit 22. Housing 36 has slots 112 through which ears 62 extend. Nails 114 are inserted through holes 115 in ears 62 to retain housing 36 in position during assembly of range hood 26, as shown in FIG. 5.

Hood portion 30 of range hood 26 is placed on lips 78 and pivoted into position, also as shown in FIG. 5, so that flanges 80 lie along the inside of ducts 32 and 34, as shown in FIG. 6. Bolts 116 extend through flanges 80 of hangers 54 and 56 to secure hood portion 30 and ducts 32 and 34 to mounting member 50. Lips 78 are then bent up, as shown in FIG. 6 to assist in securing hood portion 30 on hangers 54 and 56.

Housing 36 and ducts 32 and 34 may then be connected together, the necessary wiring completed, final assembly of parts in the hood finished, nails 114 removed, grill 110 placed on housing 36, and microwave oven 28 placed on the shelf formed by hood portion 30.

Various modes of carrying out the invention are contemplated as being within the scope of the following claims particularly pointing out and distinctly claiming the subject matter which is regarded as the invention.

We claim:

1. Improved mounting means for securing, by means of fasteners, a load bearing range hood to a horizontal framing member on a wall, the range hood having a hood portion positionable above the range, a pair of side elements, and a blower housing, said mounting means comprising:

an elongated mounting plate suitable for being secured generally horizontally to the framing member, said mounting plate including a first flange portion lying in a horizontal plane when said mounting means is in use and a second flange portion depending from said first flange portion and lying in a vertical plane when said mounting means is in use, said first flange portion including spaced perforations adjacent said second flange portion for receiving the fasteners for said mounting means, the area of said first flange portion adjacent said perforations slanting downwardly with respect to the remaining portions of said first flange portion so that the fasteners may be inserted into the framing member in an upwardly slanting direction; and a pair of hangers depending from said mounting plate at spaced locations therealong, each of said hangers having an upper end connected to said mounting plate, a lower, free, unconnected end, and an intermediate portion, said hangers containing means in the intermediate portions and on the lower ends for securing the range hood to said mounting means.

2. The improved mounting means according to claim 1 wherein said second flange portion includes perforations for receiving fasteners to secure said mounting plate to the wall.

3. The mounting means according to claim 1 wherein said hangers are removably connected to said mounting plate.

4. The improved mounting means according to claim 3 wherein said upper ends of said hangers have lips extending through perforations in said second flange portion for connecting said hangers to said mounting plate.

5. The mounting means according to claim 1 wherein said hangers have flanges in said intermediate portions by which the side elements of the range hood may be secured to said mounting means.

6. The improved mounting means according to claim 1 wherein said hangers having perforations for receiving additional fasteners to secure said hangers to the wall.

7. The mounting means according to claim 1 wherein said lower free, unconnected ends of said hangers contain lips for receiving the range hood.

8. The mounting means according to claim 7 wherein said lips are bendable.

9. The mounting means according to claim 1 wherein said first flange portion of said mounting means contains depending ears at the ends thereof for temporarily suspending the blower housing of the range hood, said depending ears extending downwardly when said mounting means is in use.

* * * * *